US008127954B2

(12) United States Patent
Cano-Pey et al.

(10) Patent No.: US 8,127,954 B2
(45) Date of Patent: Mar. 6, 2012

(54) CLOSURE WITH HINGED LID FOR BOTTLES AND THE LIKE WITH AN AUTOMATIC LID OPENING SYSTEM

(75) Inventors: Max Cano-Pey, Torelló (ES); Josep Fort-Prades, Tona (ES)

(73) Assignee: SEAPLAST S.A., Barcelona (ES)

( * ) Notice: Subject to any disclaimer, the term of this patent is extended or adjusted under 35 U.S.C. 154(b) by 784 days.

(21) Appl. No.: 12/227,062

(22) PCT Filed: May 15, 2007

(86) PCT No.: PCT/EP2007/004306

§ 371 (c)(1),
(2), (4) Date: Nov. 6, 2008

(87) PCT Pub. No.: WO2007/134755

PCT Pub. Date: Nov. 29, 2007

(65) Prior Publication Data

US 2009/0159552 A1 Jun. 25, 2009

(30) Foreign Application Priority Data

May 18, 2006 (ES) ..... 200601273

(51) Int. Cl.
*B65D 39/00* (2006.01)

(52) U.S. Cl. ..... 215/235; 215/237; 215/238; 220/263; 220/810

(58) Field of Classification Search ..... 215/235, 215/236, 237, 238, 244, 245; 220/260, 262, 220/263, 264, 810, 836, 837, 838
See application file for complete search history.

(56) References Cited

U.S. PATENT DOCUMENTS

| | | | | |
|---|---|---|---|---|
| 5,358,130 | A | 10/1994 | Mengeu et al. | |
| 5,361,920 | A * | 11/1994 | Nozawa et al. | 215/237 |
| 5,620,107 | A * | 4/1997 | Takeuchi | 215/235 |
| 5,762,216 | A * | 6/1998 | Takeuchi | 215/235 |
| 2001/0050264 | A1 | 12/2001 | Schorner | |
| 2005/0218105 | A1 | 10/2005 | Arai | |

FOREIGN PATENT DOCUMENTS

| | | | |
|---|---|---|---|
| EP | 0 494 306 | A1 | 7/1992 |
| EP | 0 976 663 | A1 | 2/2000 |
| EP | 1 582 476 | A1 | 10/2005 |
| WO | 03/084835 | A1 | 10/2003 |

OTHER PUBLICATIONS

International Search Report (Form PCT/ISA/210) (mailed on Sep. 10, 2007 in connection with International Application No. PCT/EP2007/004306).

* cited by examiner

*Primary Examiner* — Jacob K Ackun
*Assistant Examiner* — Kareen Rush
(74) *Attorney, Agent, or Firm* — Staas & Halsey LLP

(57) ABSTRACT

Closure with hinged lid for bottles and the like with an automatic lid opening system. The closure includes an elastic element made from elastomer material that exerts a spring-back force on the lid towards its open position, and an anchoring member between the main body of the closure and the lid. The elastic element has an extendible section defined between a first joining area to a main body and a second joining area to the lid. The main body includes a projection that defines a seating surface positioned externally with respect to a hinge joint of the lid. The extendible section extends freely opposite the seating surface and rests on the seating surface in the hinged position of the lid.

19 Claims, 7 Drawing Sheets

CLOSURE WITH HINGED LID FOR BOTTLES AND THE LIKE WITH AN AUTOMATIC LID OPENING SYSTEM

CROSS REFERENCE TO RELATED APPLICATIONS

This application claims the benefit, under 35 U.S.C. Section 371, of International Application No. PCT/EP2007/004306, filed May 15, 2007, which claimed priority to Spanish Application No 200601273, filed May 18, 2006 in the Spanish Patent and Trademark Office, the contents of both of which are incorporated herein by reference.

FIELD OF THE INVENTION

The invention relates to the field of closures with hinged lids for bottles and the like.

More particularly, the invention relates to a closure with a hinged lid for bottles and the like having an automatic lid opening system, said closure comprising:

- a main body, having a supply mouth, suitable for being applied to the neck of a bottle or the like;
- a hinged lid joined to said main body by a hinge joint, so that said lid can pivot between an open position and a hinged position in which it blocks said supply mouth; said main body and said lid being moulded from rigid plastics material;
- an elastic element arranged between said main body and said lid so that it exerts a spring-back force on said lid towards its open position, said elastic element being made from an elastomer material other than said rigid plastics material;
- anchoring means between said lid and said main body suitable for retaining said lid in its hinged position; and
- a button suitable for operating the release of said anchoring means, so that by acting upon said button the lid is opened automatically and completely due to the action of the spring-back force exerted by said elastic element.

STATE OF THE ART

Various closures of the type indicated at the beginning are known.

For example, documents EP0826606, EP0839735 and EP0975526 describe a closure of the type described at the beginning. A first characteristic of this closure is that the elastic element made from elastomer material extends over the lid and the main body covering the anchoring means, so that said anchoring means are pleasant to touch when the user acts upon them to release them. This solution suffers from the drawback that an additional amount of elastomer material is required that must be moulded according to a relatively complicated shape, which has a negative affect on the closure's manufacturing cost. Furthermore, these anchoring means combined with the elastomer material do not form a button in the strict sense.

A second characteristic of the closure disclosed by said documents EP0826606, EP0839735 and EP0975526 is that the elastic element has an extendible section that passes from one side to the other of the hinge joint when the lid pivots between its open and hinged positions. Consequently, said extendible section is extended to the maximum when the lid is in an intermediate position, whereby the lid has two rest positions: the open position and the hinged position. When the lid is in the hinged position and the user wants to open it, he must release the anchoring means and push the lid against the force of the elastic element, beyond the intermediate position. This mode of operation suffers from the drawback that it complicates the lid opening operation for the user, and does not open the lid automatically and completely with one simple pressing action.

A third characteristic of the closure disclosed in said documents EP0826606, EP0839735 and EP0975526 is that, in addition to forming an extendible section on level with the hinge joint so as to produce a spring-back function for the lid, the elastomer material also extends over part of the lid to ensure the seal of the supply hole. In particular, the elastomer material extends over the outer wall of a pin that is provided on the lid and which is forcibly inserted into the supply mouth, whereby the elastomer material is compressed between the outer wall of the pin and the inner wall of the supply mouth. This solution suffers from the drawback that the pin is firmly wedged in the supply mouth, and so considerable force is required to open the lid.

Document EP0976663 discloses a closure of the type considered at the beginning, but which is different to the closure disclosed in the said documents EP0826606, EP0839735 and EP0975526 because the lid's only rest position is the open position, which corresponds to a minimum extension of the extendible section of the elastic element. This mode of operation is obtained by virtue of the elastic element having an extendible section that is arranged between two ribs that form the hinge joint, and is joined to said ribs, so that said extendible section cannot pass freely from one side to the other of the hinge joint. With respect to the opening system, in this case the closure comprises an elastic button made from the elastomer material. The user presses said elastic button to release the anchoring means and thus causes the lid to open automatically thanks to the spring-back force exerted on said lid. As for the seal of the supply mouth, in this case the lid is provided with a pin that is inserted into said supply mouth, but contrary to the closures cited above, the elastomer material does not extend over the pin, instead it forms the top edge of the supply mouth on the main body. In order to open the lid considerable force is required to extract the pin inserted into the supply mouth. Therefore, so that the lid opens automatically once the anchoring means have been released, the extendible section of the elastic element must exert a strong spring-back force. Furthermore, said extendible section has limited elasticity, since it is attached to the ribs forming the hinge joint. Consequently, the lid's opening movement is fairly abrupt, which is not very pleasant for the user. Also, the design of the push button formed by the elastomer material has a negative affect on the closure's manufacturing costs.

Document JP8113260 relates to a closure that resembles the type of closure referenced in the invention, but wherein the anchoring means are not released by means of a button, but rather by traditional means, pulling a visor provided on the lid. In this case, the elastomer material only performs the lid's spring-back function, and it consists of a separate part that fits at its ends into housings provided in the lid and in the main body of the closure, and has an intermediate extendible section that is freely positioned externally with respect to the hinge joint. The lid's only rest position is the open position, which corresponds to a maximum extension of the extendible section. This is achieved by virtue of a projection, provided on the outer surface of the lid, which receives and supports said extendible section and keeps it positioned externally with respect to the hinge joint. This projection arrangement suffers from the drawback that it imposes significant restrictions on the lid's external design. For example, it makes it impossible to design a lid with a clear surface. Another drawback of this arrangement is that the projection has a reduced support surface that causes localised tension and wears the extendible section of the elastic element. Moreover, by arranging said projection it is not possible to manufacture the closure as an integral part by overmoulding the elastomer material, since the part cannot be stripped from the mould.

Document WO2004110889 discloses a type of closure in which the hinge joint is made from the actual elastic element arranged as a single connection means between the lid and the main body. This solution is different to the type of closure described in the invention and suffers from the drawback that it considerably complicates closure manufacturing. Moreover, in this case the closure does not comprise anchoring means in the strict sense; the function of maintaining the lid in its hinged position is carried out by the actual pin provided on the lid, which is inserted into the supply mouth to seal it and remains fixed therein by virtue of friction. The closure is provided with a button that is operated by pressing the lid upwards until the pin withdraws from the supply mouth. This opening system suffers from the drawback that the user must act upon the button, moving it sufficiently to remove the pin from the supply mouth. This is not very comfortable and differs from the operation of a proper button, which must act instantly.

SUMMARY OF THE INVENTION

The aim of the invention is to provide a closure of the type indicated at the beginning, which enables the lid to be opened automatically and completely by acting upon a button with a simple, comfortable action, and which does not suffer from the drawbacks of the known closures mentioned above.

In particular, the main aim of the invention is to provide a closure wherein the design of the elastic element, as well as the closure parts interacting with said elastic element, provides an improved automatic lid opening action, in particular a more effective opening action that is not too abrupt, and which does not negatively affect the closure manufacturing costs and does not excessively compromise the freedom of the closure's aesthetic design.

This aim 1s achieved by means of a closure of the type indicated at the beginning, characterised in that

- the elastic element has at least one first joining area fixedly attached to said main body and at least one second joining area fixedly attached to said lid, with at least one extendible section of said elastic element being defined between said first and second joining areas;
- the main body of the closure comprises at least one projection that defines a seating surface positioned externally with respect to said hinge joint; and
- said extendible section of the elastic element extends freely in front of said seating surface, so that when the lid pivots towards its hinged position said seating surface receives said extendible section of the elastic element, which rests on said seating surface, and keeps said extendible section positioned externally with respect to the hinge joint. This arrangement ensures that the extendible section of the elastic element is always positioned externally with respect to the hinge joint, whereby the lid's only rest position is the open position that corresponds to a minimum extension of the elastic element's extendible section. By virtue of the fact that the extendible section is arranged freely opposite the seating surface, its elasticity is not affected by interference with the rigid elements of the closure. Moreover, providing said projection on the main body of the closure maintains the freedom of the lid's design, making particularly advantageous solutions possible.

One of these advantageous solutions consists in the projection defining the seating surface extending from a lower end of the main body next to said first joining area of the elastic element, to an upper end that projects from said main body and that is next to said second joining area of the elastic element when the lid is in its hinged position. By virtue of this arrangement, when the lid is in the hinged position the extendible section of the elastic element rests its entire length on the seating surface, thereby avoiding localised tension and wear. Also said extendible section is prevented from catching on any outside body while the bottle incorporating the closure is in transit or being handled.

Preferably, said seating surface has a convex shaped section on which the elastic element's extendible section rests in the lid's hinged position, therefore providing gentle support that prevents localised tension.

In a preferred embodiment of the invention, said second joining area of the elastic element has an elongated shape that extends parallel to the axis of said hinge joint, and said elastic element has two of said first joining areas, separated by an open space facing said hinge joint, and two of said free extendible sections defined between said first joining areas and said second joining area, said main body comprising two of said projections that respectively define two of said seating surfaces positioned externally with respect to the hinge joint and respectively facing said two extendible sections of the elastic element. This arrangement distributes the elastic effort between two extendible sections, thereby allowing an improved spring-back force adjustment. Also, it makes it easier to form the hinge joint, which is framed at the sides by the two extendible sections.

In an advantageous embodiment of the invention, said main body and said lid have a contour that is truncated by respective flat surfaces joined by a bridge that forms said hinge joint, said projection protruding from the flat surface of the main body, and said flat surface of the lid having at least one window through which said projection and said extendible section of the elastic element protrude when the lid is in the hinged position. This embodiment of the closure has the advantage that it is particularly compact.

The invention contemplates, optionally, some advantageous embodiments including characteristics regarding the button. These characteristics, in combination with those described above regarding the elastic element and the parts of the closure interacting with it, make it possible to obtain a closure having a button that acts quickly releasing the anchoring means between the lid and the main body, efficiently opening the lid, and without it being necessary to use elastomer material to form the button and without significantly complicating the manufacturing process.

In an advantageous embodiment of the invention, the main body has a side wall and an upper base on which the supply mouth is provided; the button is made up of a moveable area that is moulded as an integral part of said main body in rigid plastics material and has at least one front portion delimited on said side wall and joined at its lower end to said side wall by a joining line that defines a pivoting axis of said movable area, said front portion having a pressing surface suitable for receiving a user's finger; and the anchoring means comprise a first part formed in said movable area and a second part formed on said lid and suitable for anchoring in said first part. This closure according to the invention does not require using elastomer material to form the button; it is based on local geometric forms defined in the actual rigid plastics material of the main body and the lid. Moreover, thanks to the fact that the first part of said anchoring means is provided in the movable area of the main body, when the button is activated, the second part of the anchoring means are released directly and the lid is opened. The surface for activating the button is located in the actual movable area, whereby the user acts directly on the movable area. This direct activation and release, combined with the spring-back force exerted by the elastic element provided between the lid and the main body, easily and effectively opens the lid. In order to activate the button, the user acts upon the pressing surface defined on the front portion of the button, in other words on the side wall of the main body, so that the lid can be opened comfortably with one simple finger movement, while holding the bottle in one hand.

Preferably, said movable area is delimited on said main body by a deformable contour defined by a geometric weakening of the actual wall of said main body. This deformable contour makes the button more robust and, since it is deformable, allows the movable area limited but sufficient pivoting around the joining line.

Preferably, the geometric weakening of the wall of the main body that forms said deformable contour has, in section, a toggled shape and a reduced thickness with respect to the adjacent areas of said wall. By virtue of this particular shape, the deformable contour can be slightly stretched and contracted, allowing the movable area sufficient movement to release the anchoring means. Moreover, this geometric arrangement can be obtained easily during the moulding operation for the closure's main body.

Advantageously, said deformable contour has an upper section that defines in said upper base an upper part of the movable area and respective side sections that define in said side wall the front portion of the movable area, said side sections extending the ends of said upper section as far as said joining line. With this arrangement a particularly robust button is obtained. When using the finger to press the pressing surface, the movable area is pivoted with little effort because the contour of the upper section contracts and the side sections are deformed sideways. The button only works if the pressing area is pressed in a direction that is noticeably perpendicular to the closure's side wall, thereby minimising the possibility that the lid opens accidentally when it comes into contact with some external element.

Preferably, said geometric weakening forms said deformable contour in the shape of a groove the depth of which decreases in said side sections towards the lower ends thereof, which reinforces the button without considerably affecting the pivoting of the deformable area around the joining line.

Preferably, the anchoring means consist of a window in said front portion of the movable area and a hook-shaped projection formed on the lid. When the user acts upon the pressing surface, the moveable area is moved away from the side wall thereby unhooking the projection from the window.

Preferably, said deformable contour defines a continuous joining surface between said movable area and the rest of said main body, thereby preventing dirt or any external element from entering through the deformable contour.

The invention also contemplates, optionally, some advantageous embodiments including characteristics regarding the lid's seal of the supply mouth. These characteristics are intended to provide a closure wherein the interaction between the lid and the supply mouth does not produce significant friction between these elements, so that when the anchoring means are released by acting upon the button, the lid opens without any impediment, stretched by the spring-back action of the elastic element, without the latter having to exert any significant force to unblock the supply mouth.

So, in a preferred embodiment of the invention, said lid is provided on its inner surface with a flat contact area made from elastomer material and facing said supply mouth in the lid's hinged position, so that said flat contact area of the elastic element is applied against the upper edge of said supply mouth. This flat contact area made from elastomer material ensures the supply mouth has an airtight seal, without any outer or inner coupling with the supply mouth, whereby said supply mouth is unblocked simply by lifting the lid, without it being necessary to overcome any strong friction force.

Preferably, the inner surface of said lid has a hollow area that houses said flat contact area, and makes it easier to join it to the lid when manufacturing the closure.

Preferably, said elastic element made from elastomer material that ensures the lid's spring-back action, also forms said flat contact area. This avoids having different pieces of elastomer material and facilitates the closure manufacture process by overmoulding the elastomer material over the rigid plastics material of the main body and the lid.

Preferably, said elastic element comprises a connection strip that extends between said flat contact area and the part of the elastic element where the second joining area is provided, and the inner surface of said lid has a channel that leads into said hollow area and houses said connection strip. In particular, this solution facilitates forming the elastic element made from elastomer material with an overmoulding method, because the channel and the hollow area act as a mould.

Preferably, said flat contact area and said connection strip are arranged level with said hollow area and said channel, respectively, thereby preventing any projections on the inner surface of the lid where dirt could accumulate.

Preferably, the elastic element made from elastomer material is overmoulded on the piece of rigid plastics material made up of said main body and said lid, for example using a bi-injection method. In an advantageous solution, said elastic element goes through the thickness of said lid from said contact area and forms an outer layer of elastomer material that extends over at least part of the lid's outer surface. This way the elastomer material can be injected over the lid's outer surface and, at the same time, an outer coating of elastomer material can be obtained that is suitable for forming a publicity or geometric motif that personalises the closure.

BRIEF DESCRIPTION OF THE DRAWINGS

Other advantages and characteristics of the invention will be appreciated from the following description which, in a non-limiting manner explains preferable embodiments of the invention, with reference to the accompanying drawings, in which:

FIG. 11 is a fictitious breakdown of FIG. 10 wherein the elastic element made from elastomer material has been shown apart as it appears in the position shown in FIG. 10.

FIG. 13 is a fictitious breakdown of FIG. 12 wherein the elastic element made of elastomer material has been shown apart as it appears in the position shown in FIG. 12;

FIG. 16 is a fictitious breakdown of FIG. 15 wherein the elastic element made of elastomer material has been shown apart as it appears in the position shown in FIG. 15.

DETAILED DESCRIPTION OF SOME EMBODIMENTS OF THE INVENTION

Figure 1:
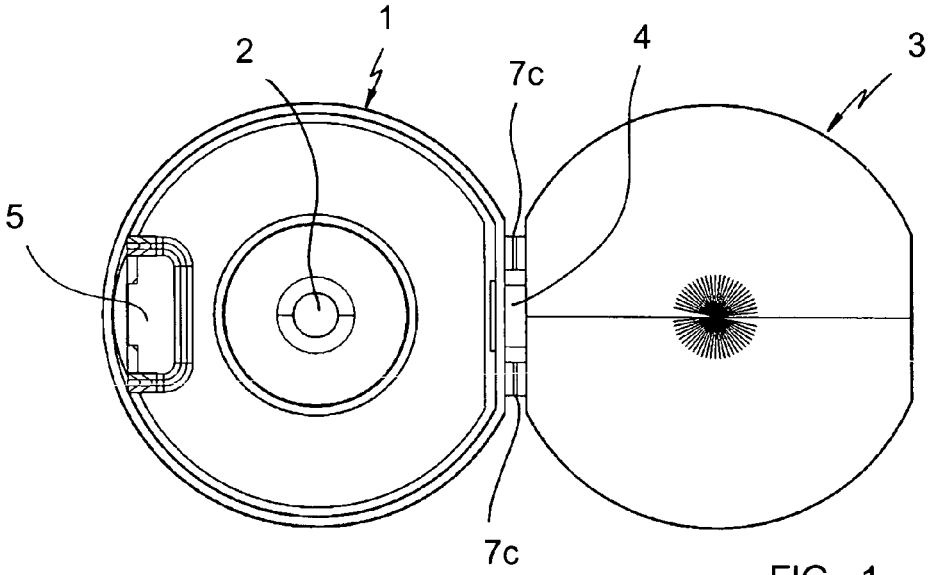
FIGS. 1, 2 and 3, respectively, a lower, side and upper view of a closure according to a first embodiment of the invention, with the lid in the open position.
Figure 2:
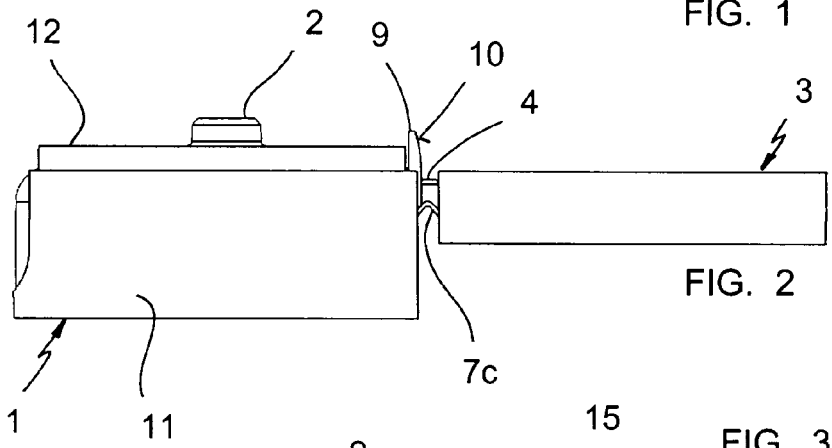
Figure 3:
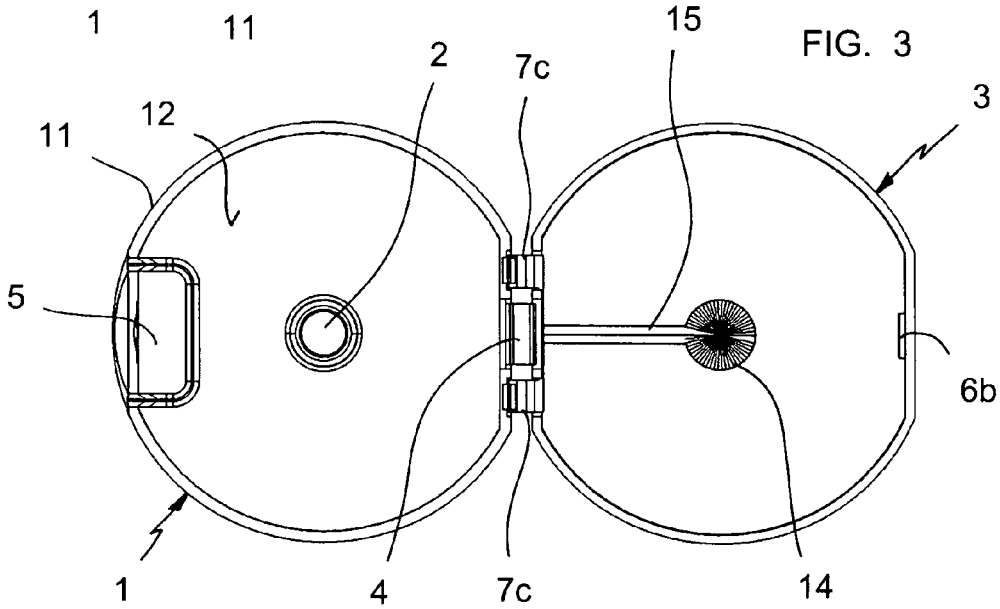

FIGS. 1 to 13 illustrate a first embodiment of a closure according to the invention, which is intended to be applied to bottles of water and which enables the lid to be opened easily with the same hand that is holding the bottle, by using a finger to press a button provided on the closure's main body.

The closure is made up of a main body 1, which has a supply mouth 2, and a lid 3 that is joined to the main body 1 by a bridge 4 that performs the functions of a hinge joint. Main body 1 and lid 3 are moulded as an integral part in a rigid plastics material, for example polypropylene. Lid 3 can pivot with respect to the axis formed by the hinge joint 4 between an open position and a hinged position wherein lid 3 blocks supply mouth 2. An elastic element 7, made from elastomer material, for example a thermoplastic elastomer (TPE), joins main body 1 and lid 3 so that it exerts a spring-back force on lid 3 towards its open position.

Elastic element 7 has an extendible section 7*c* freely positioned externally with respect to hinge joint 4, so that when lid 3 is closed, making it pivot from its open position, extendible section 7*c* gradually becomes tenser and therefore always exerts a spring-back force on lid 3 towards its open position. As can be seen in particular in FIGS. 10 to 13, elastic element 7 has two joining areas 7*a* integral with main body 1 and one second joining area 7*b* integral with lid 3. Between the first joining areas 7*a* and the second joining area 7*b* respective extendible sections 7*c* of the elastic element are provided, which are freely positioned externally with respect to hinge joint 4. The first joining areas are separated by an open space 23 that faces said hinge joint 4. Main body 1 comprises two projections 9 that define seating surfaces 10 positioned externally with respect to hinge joint 4 and face the elastic element's extendible sections 7*c*. Each projection 9 extends from a lower end located on main body 1, next to a first joining area 7*a* of the elastic element, to an upper end that projects from main body 1 and is located next to the second joining area 7*b* of the elastic element in the lid's hinged position 3. Surface 10 formed on each projection 9 has a convex shaped section at the top thereof, whereas the lower part is flat to facilitate mould stripping.

Figure 11:
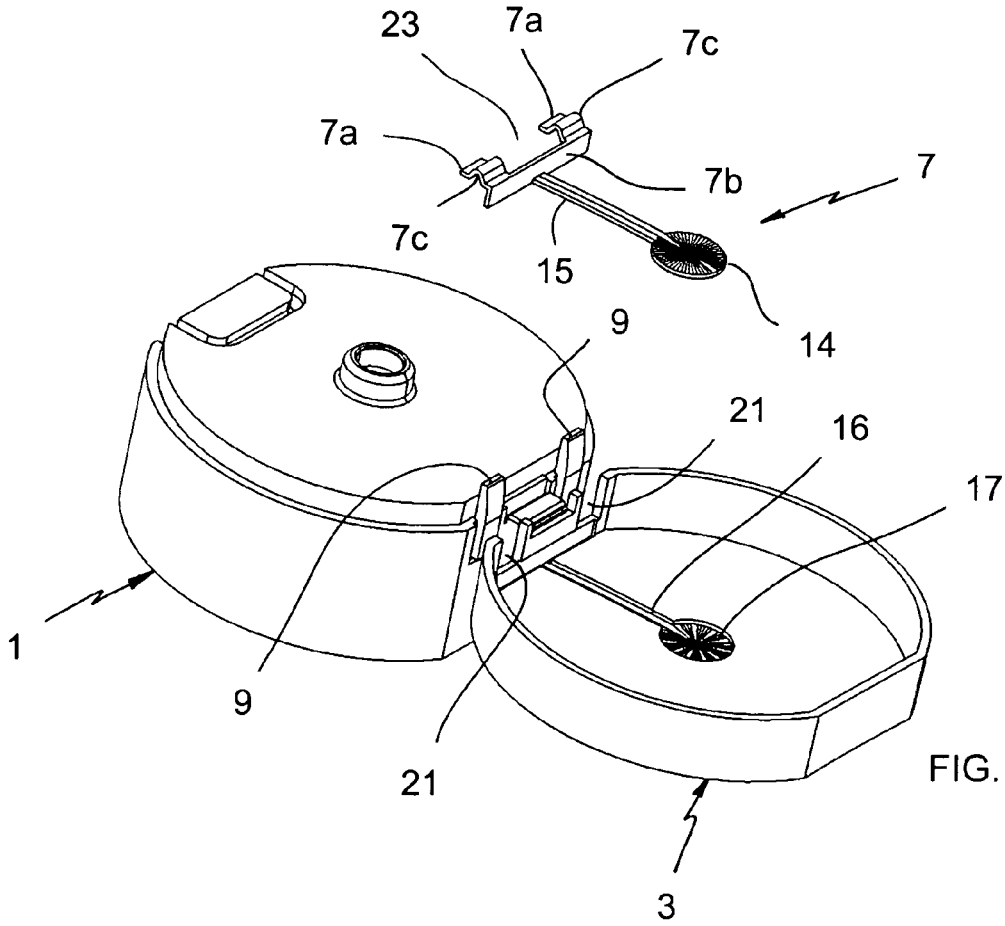

Main body 1 and lid 3 have a contour that is truncated by respective flat surfaces 19, 20 joined by the bridge 4 that forms the hinge joint. Projections 9 project from flat surface 19 of the main body and flat surface 20 of the lid has respective windows 21 through which projections 9 and extendible sections 7*c* of elastic element 7 protrude in the hinged position of lid 3, as can be seen in FIGS. 11,12 and 13.

Figure 9:
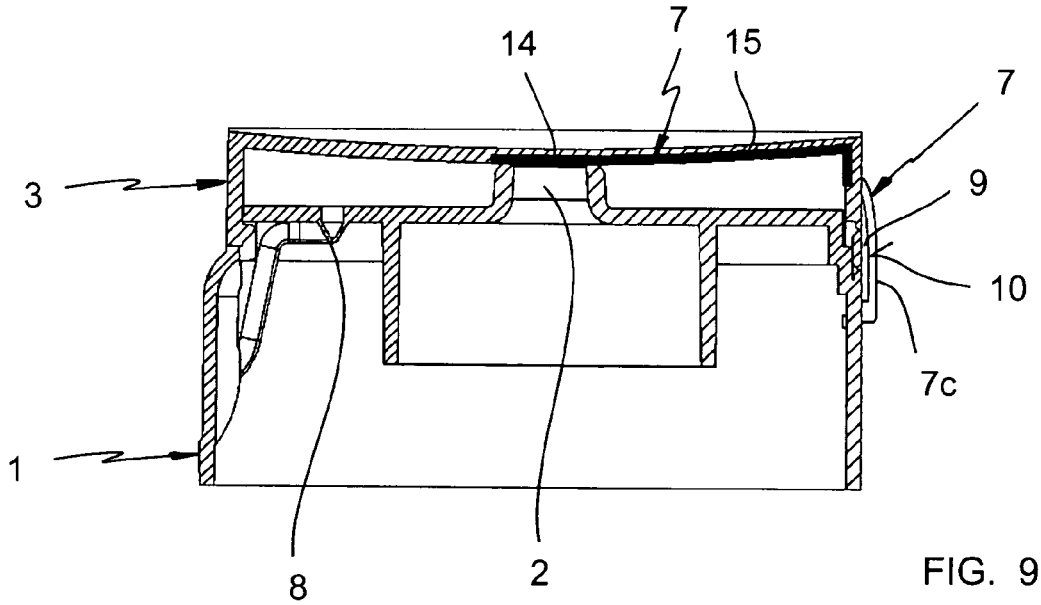
FIG. 9, a side view of said closure sectioned along a middle plane, with the lid in the hinged position.
Figure 10:
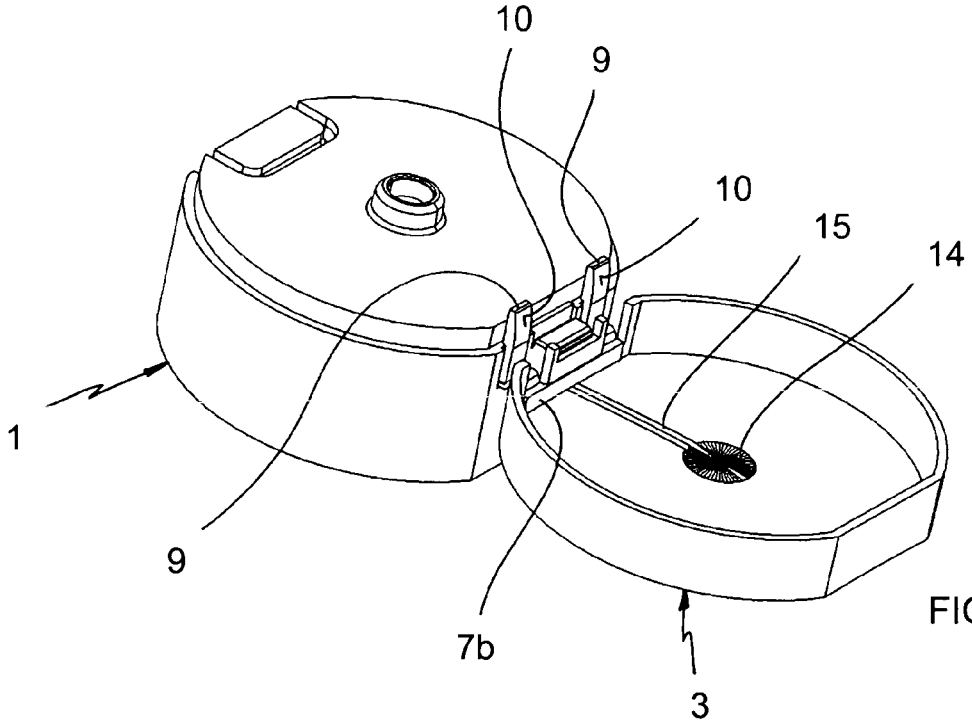
FIGS. 10 and 11, upper perspective views of said closure, with the lid in the open position.
Figure 12:
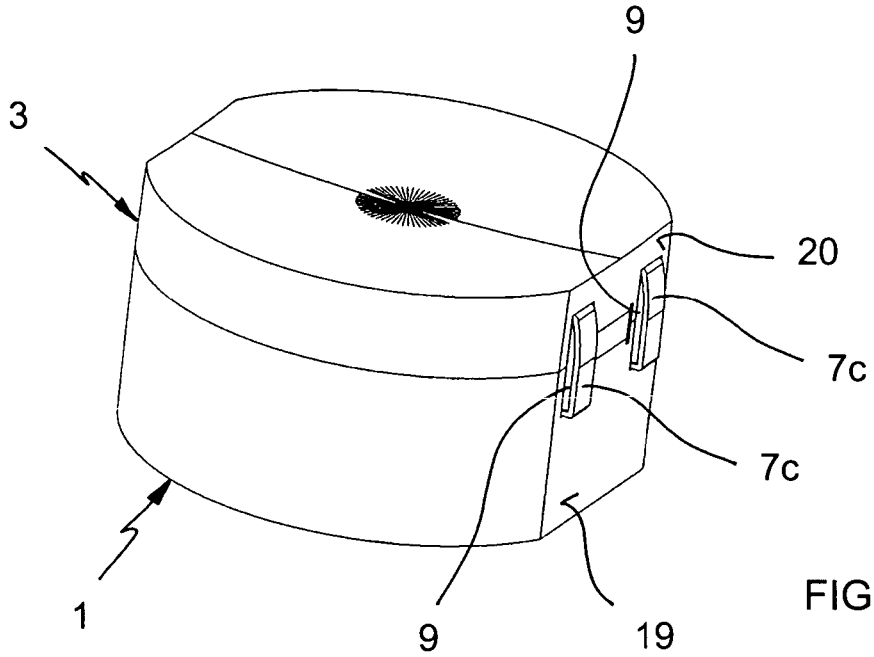
FIGS. 12 and 13, upper perspective views of said closure, with the lid in the hinged position.
Figure 13:
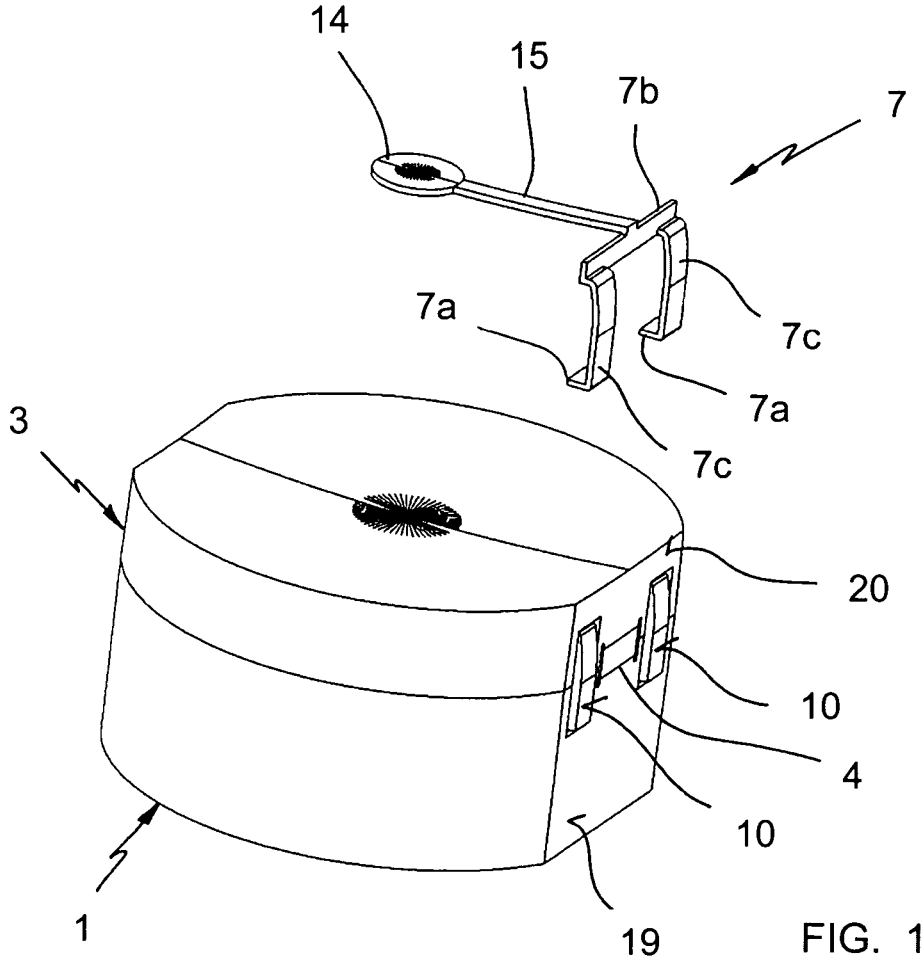

When lid 3 pivots towards the hinged position illustrated in FIGS. 9, 12 and 13, seating surfaces 10 receive and support extendible sections 7*c* of elastic element 7 and keep them positioned externally with respect to hinge joint 4. By virtue of this arrangement, in any position of lid 3 between its open and hinged positions, extendible sections 7*c* are extended elastically, with respect to their state in said open position of lid 3, whereby said open position is the only rest position of lid 3. As can be seen in said figures, in the lid's hinged position the entire length of each extendible section is applied against surface 10.

Figure 4:
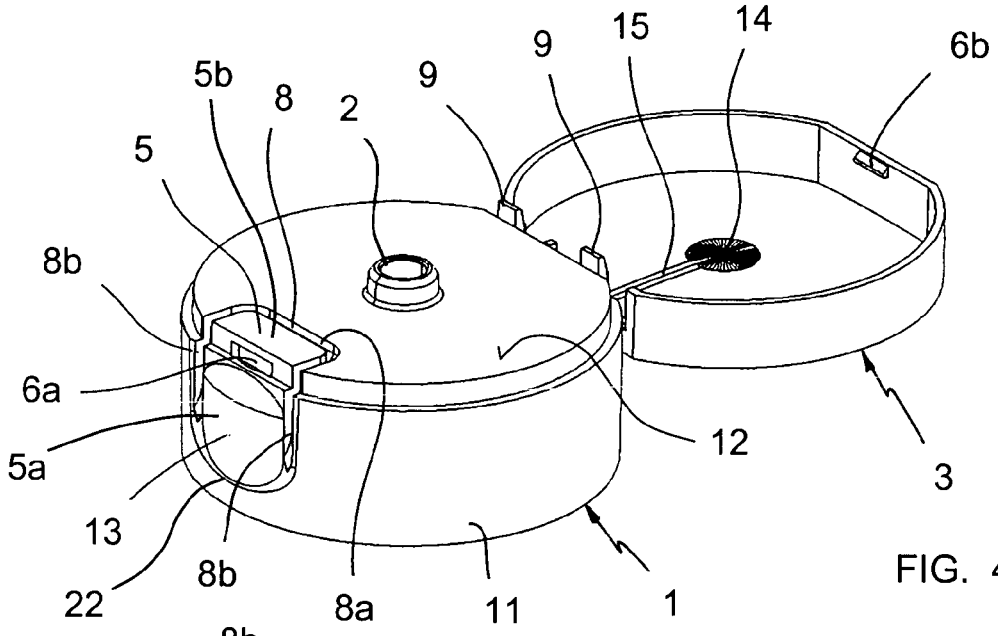
FIG. 4, an upper perspective view of said closure.
Figure 5:
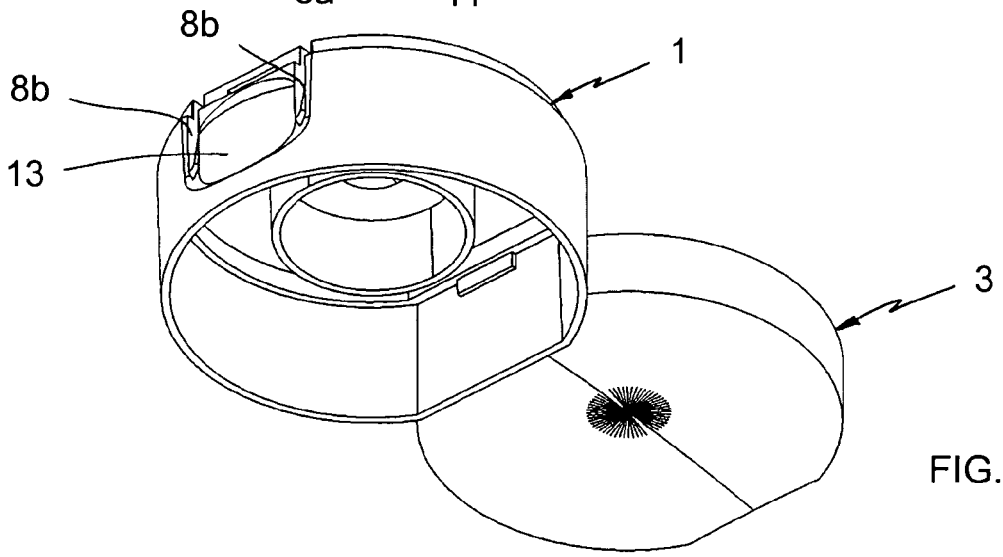
FIGS. 5 and 6, lower perspective views, respectively front and back, of said closure.
Figure 6:
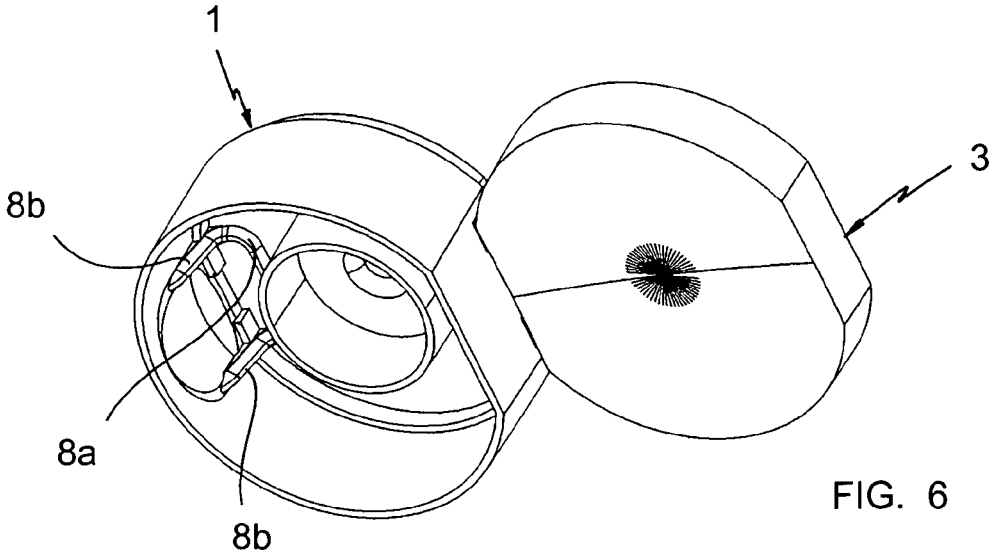
Figure 7:
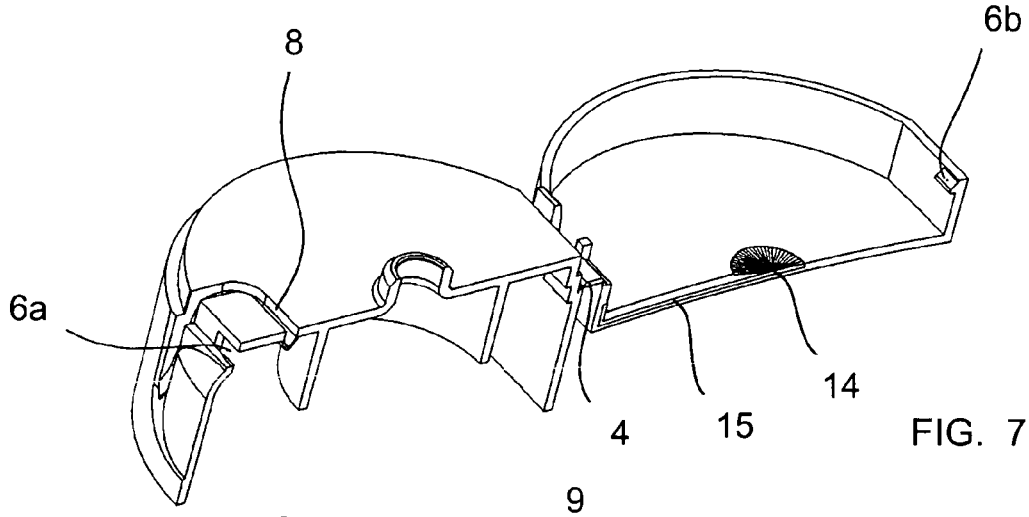
FIGS. 7 and 8, respectively, upper and lower perspective views of said closure, sectioned along a middle plane.
Figure 8:
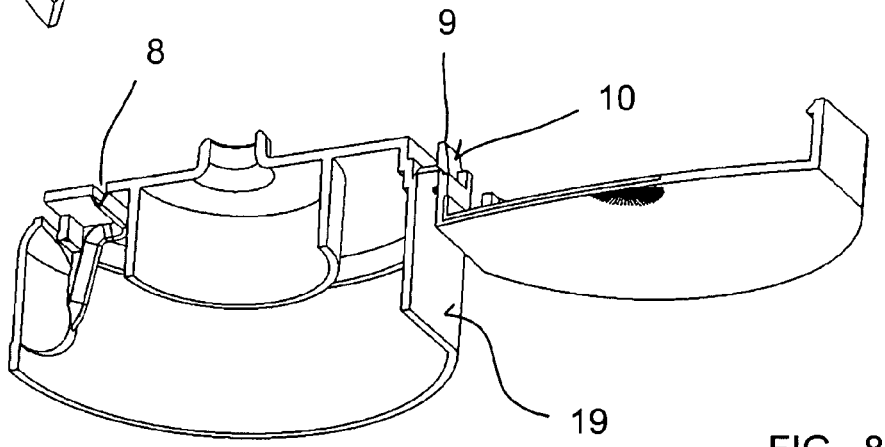

This embodiment of the closure according to the invention also includes specific characteristics regarding the button. Main body 1 has an overall cylindrical shape, with a side wall 11 and an upper base 12 in which supply mouth 2 is provided, and it has a movable area 5 delimited by a deformable contour 8 defined by a geometric weakness in the actual wall of main body 1, as can be seen in greater detail in FIGS. 4 to 6. The geometric weakness that shapes deformable contour 8 has, in section, a toggled shape and a reduced thickness with respect to the adjacent areas of the wall of main body 1, and defines a continuous joining surface between said movable area 5 and the rest of main body 1, as can be seen in particular in FIGS. 7 to 9. The thus formed deformable contour 8 has a U-shaped upper section 8*a* provided in upper base 12 of main body 1 and respective side sections 8*b* that extend into side wall 11 extending the ends of upper section 8*a* and defining in said side wall 11*a* front portion 5*a* of movable area 5. The lower end of said front portion 5*a*, in to which the two side sections 8*b* lead, is joined to side wall 11 forming a joining line 22 around which movable area 5 pivots. As can be seen in FIGS. 4 to 6, the depth of the groove formed by the geometric weakness that shapes contour 8 decreases towards the lower ends of side sections 8*a*, as far as joining line 22. A pressing surface 13, suitable for receiving a user's finger, is provided on front portion 5*a* of movable area 5.

The closure comprises anchoring means between lid 3 and main body 1 consisting of a window 6*a* in front portion 5*a* of movable area 5 and a hook-shaped projection 6*b* formed on lid 3. In order to close lid 3, the user pivots it by acting against the spring-back force of elastic element 7, until the lid reaches the hinged position shown in FIG. 9, wherein projection 6*b* is anchored in window 6*a*.

The thus formed movable area 5 forms a button suitable for operating the release of said anchoring means 6*a*, 6*b* and causing the subsequent automatic opening of lid 3. To do this, the user presses pressing surface 13 with his finger causing movable area 5 to pivot slightly, the top part of which moves away from wall 11, whereby projection 6*b* withdraws from window 6*a* and releases lid 3, which pivots to its open position thanks to the spring-back force exerted by elastic element 7. The pivoting of movable area 5 around joining line 22 is accompanied by a transverse contraction of upper section 8*a* and a sideways deformation of side sections 8*b* and the longitudinal sides of said upper section 8*a*.

Also, this embodiment of the closure according to the invention includes particular characteristics regarding the lid's airtight seal of the supply mouth. Elastic element 7 made from elastomer material extends, from the part where the second joining area 7*b* is provided, along a connection strip 15 to form at the end of the latter a flat contact area 14 between lid 3 and supply mouth 2. The inner surface of lid 3 has a channel 16 that leads into said central hollow area 17. Elastic element 7 made from elastomer material is formed by an overmoulding method over the piece of rigid plastics material formed by main body 1 and lid 3, so that connection strip 15 and flat contact area 14 are provided on level, respectively, with said channel 16 and said hollow area 17. As can be seen in FIG. 9, in the hinged position of lid 3 flat contact area 14 made from elastomer material is applied against the upper edge of supply mouth 2, without being inserted therein through friction.

Figure 14:
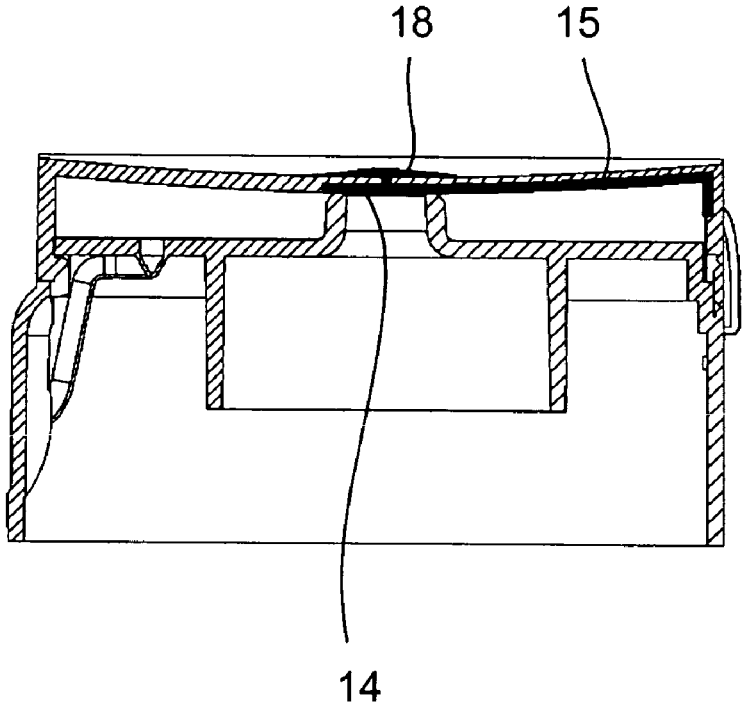
FIG. 14, a side view, sectioned along a middle plane, of a closure according to a second embodiment that differs from the first only in that the elastomer material extends along the outer surface of the lid.

FIG. 14 illustrates a second embodiment that is a variant of the first. In this case, lid 3 has a central hole through which the elastomer material is injected in the overmoulding process, so that elastic element 7 that is made from elastomer material and is formed by this process goes through the thickness of lid 3 from said flat contact area 14 and forms an outer layer 18 of elastomer material that extends over part of the outer surface of lid 3. The shape and appearance of said external layer 18 can be personalised for each closure.

Figure 15:
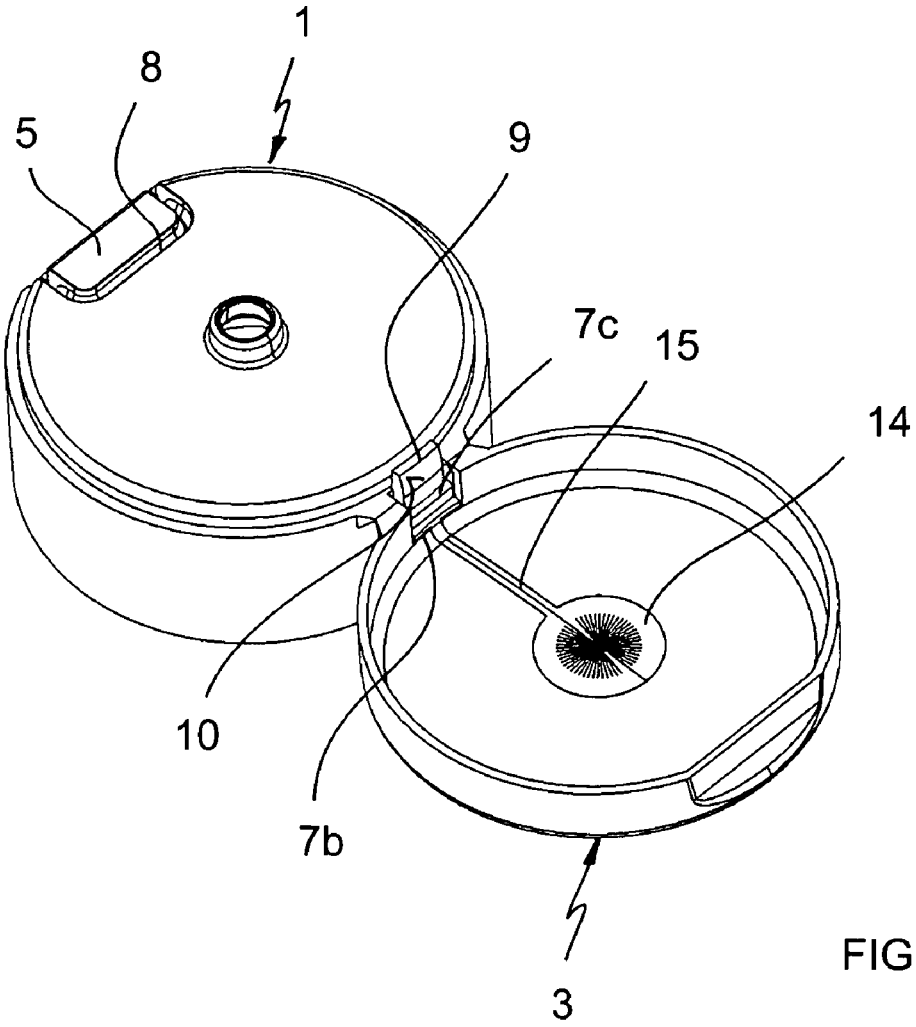
FIGS. 15 and 16, upper perspective views of a third embodiment of the closure, which differs from the previous ones in that the elastic element has one single extendible section in the central position.
Figure 16:
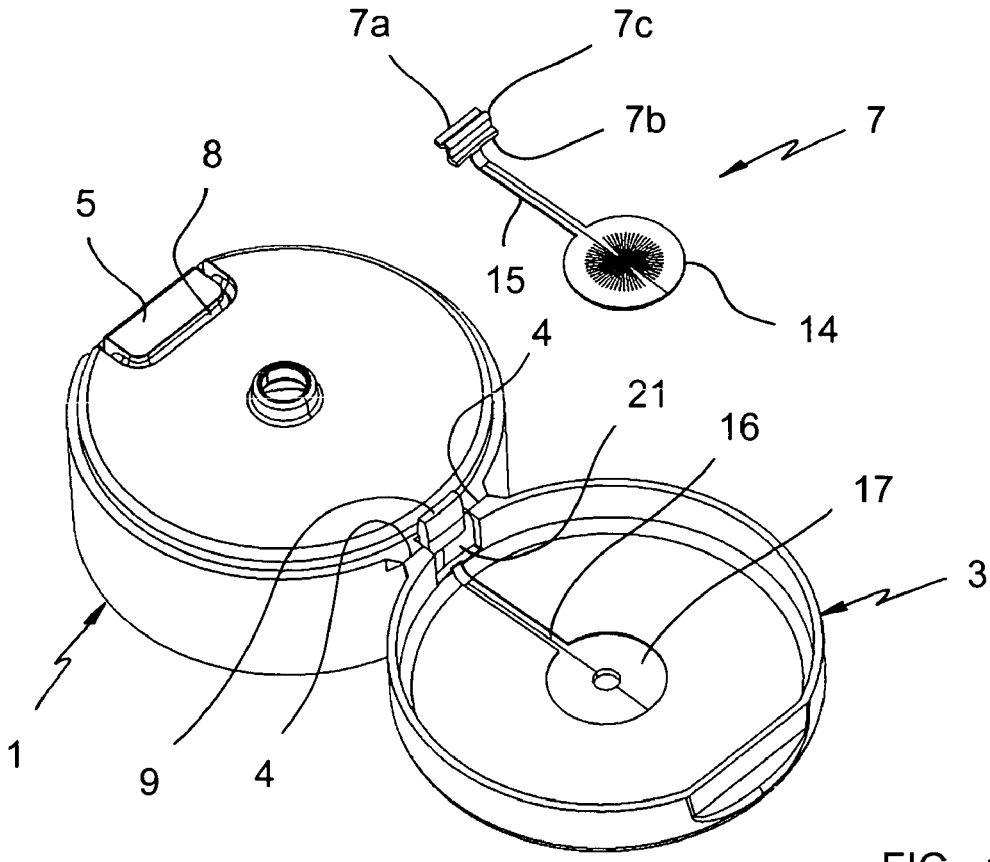
Figure 17:
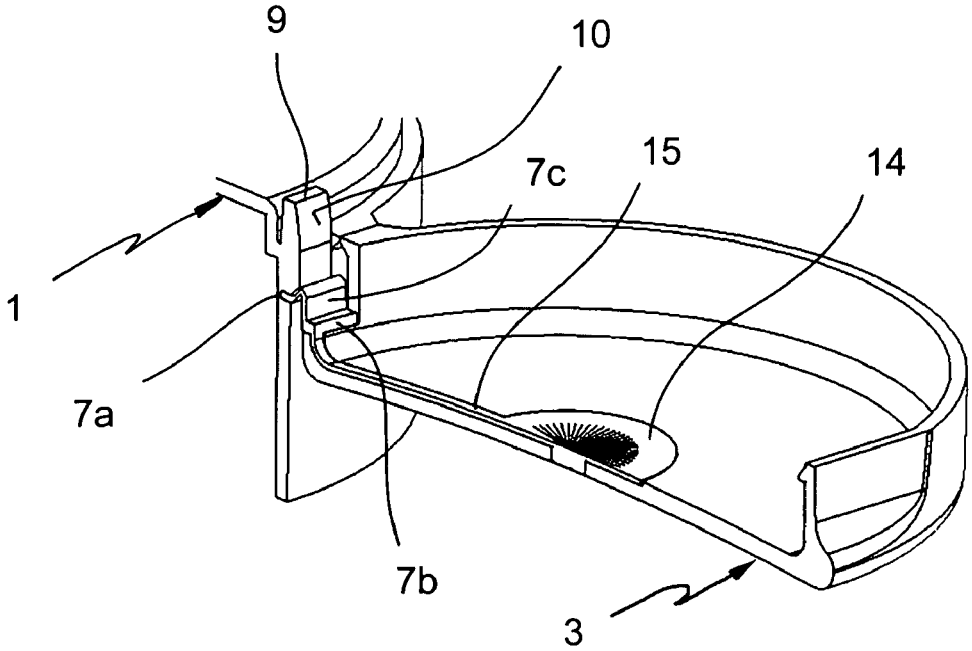
FIG. 17, a partial perspective view, sectioned along a middle plane, of the closure in FIGS. 15 and 16.

Finally, FIGS. 15 to 17 illustrate a third embodiment of the invention wherein an elastic element 7 has been provided with a single joining area 7*a* joined to the second joining area 7*b* by a single extendible section 7*c*. Main body 1 has a single central projection 9. In this case, main body 1 and lid 3 do not have a contour that is truncated on level with hinge joint 4 as in the preceding embodiments, instead said contour is substantially circular. Hinge joint 4 is made up of two parts arranged on each side of central projection 9.

The invention claimed is:

1. Closure with hinged lid for a container having an automatic lid opening system, said closure comprising:

a main body, provided with a supply mouth to be applied to a neck of the container;

a hinged lid joined to said main body by a hinge joint, so that said lid can pivot between an open position and a hinged position in which the lid blocks said supply mouth, wherein said main body and said lid are molded from a rigid plastics material;

an elastic element arranged between said main body and said lid to apply a spring-back force on said lid towards said open position, wherein said elastic element is made from an elastomer material other than said rigid plastics material;

an anchoring member between said lid and said main body for retaining said lid in said hinged position; and a button for operating the release of said anchoring member, so that by operating said button the lid is opened due to the action of the spring-back force applied by said elastic element, wherein said elastic element has at least one first joining area fixedly attached to said main body and at least one second joining area fixedly attached to said lid, with at least one extendible section of said elastic element being defined between said first and second joining areas;

wherein said main body includes at least one projection that defines a seating surface, said seating surface being positioned externally with respect to said hinge joint; and wherein said extendible section extends freely in front of said seating surface, so that when said lid pivots towards said hinged position said seating surface receives said extendible section, which rests on said seating surface, and keeps said extendible section positioned externally with respect to said hinge joint.

2. Closure according to claim 1, wherein said projection extends from a lower end located on said main body, next to said first joining area, to an upper end that projects from said main body and which is located next to said at least one second joining area when the lid is in said hinged position.

3. Closure according to claim 2, wherein said seating surface has a convex shaped section on which said extendible section of the elastic element rests in the hinged position.

4. Closure according to claim 1, wherein said at least one second joining area of the elastic element has an elongated shape that extends parallel to an axis of said hinge joint, and said elastic element has two of said first joining areas, separated by an open space facing said hinge joint, and two of said free extendible sections defined between said first joining areas and said second joining area, said main body including two of said projections that respectively define two of said seating surfaces positioned externally with respect to the hinge joint and respectively facing said two extendible sections of the elastic element.

5. Closure according to claim 1, wherein said main body and said lid have a contour truncated by respective flat surfaces joined by a bridge that forms said hinge joint, said projection projecting along said flat surface of the main body, and said flat surface of the lid having at least one opening through which said projection and said extendible section protrude when the lid is in the hinged position.

6. Closure according to any of the claim 1, wherein:

said main body has a side wall and an upper base on which said supply mouth is provided;

said button includes a movable area molded integrally with said main body in rigid plastics material, said movable area including at least one front portion delimited on said side wall and joined at its lower end to said side wall by a joining line that defines a pivoting axis of said movable area, said front portion having a pressing surface for receiving a user's finger; and said anchoring member includes a first part formed in said movable area and a second part formed in said lid for being anchored in said first part.

7. Closure according to claim 6, wherein said movable area is delimited on said main body by a deformable contour defined by a weakness of a wall of said main body.

8. Closure according to claim 7, wherein the weakness in the wall of the main has, in section, a toggled shape and a reduced thickness with respect to adjacent areas of said wall.

9. Closure according to claim 7, wherein said deformable contour has an upper section that defines in said upper base an upper part of the movable area and respective side sections that define in said side wall the front portion of the movable area, said side sections extending ends of said upper section as far as said joining line.

10. Closure according to claim 8, wherein said deformable contour is in the form of a groove which, in side sections has a depth that decreases towards lower ends of said side sections.

11. Closure according to claim 6, wherein said anchoring member includes an opening formed in said front portion of the movable area and a hook-shaped projection formed on said lid.

12. Closure according to claim 7, wherein said deformable contour defines a continuous joining surface between said movable area and a remainder of said main body.

13. Closure according to claim 1, wherein said lid has on an inner surface thereof a flat contact area made from elastomer material that faces said supply mouth in the hinged position, so that said flat contact area is applied against an upper edge of said supply mouth.

14. Closure according to claim 13, wherein the inner surface of said lid has a hollow area that houses said flat contact area.

15. Closure according to claim 13, wherein said elastic element forms said flat contact area.

16. Closure according to claim 14, wherein said elastic element includes a connection strip that extends between said flat contact area and a part of the elastic element where the second joining area is provided, and the inner surface of said lid has a channel that leads to said hollow area and houses said connection strip.

17. Closure according to claim 16, wherein said flat contact area and said connection strip are provided on level with said hollow area and said channel, respectively.

18. Closure according to claim 16, wherein said elastic element made from elastomer material is overmolded on the rigid plastics material that forms said main body and said lid.

19. Closure according to claim 18, wherein said elastic element extends through the thickness of said lid from said flat contact area and forms an external layer of elastomer material that extends over at least part of an outer surface of said lid.

* * * * *